United States Patent [19]

Takase

[11] 4,175,375

[45] Nov. 27, 1979

[54] ELECTRONIC WATCH HAVING IMPROVED LEVEL SETTING CIRCUIT

[75] Inventor: Tsuneo Takase, Yokohama, Japan

[73] Assignee: Tokyo Shibaura Electric Co., Ltd., Kanagawa, Japan

[21] Appl. No.: 845,549

[22] Filed: Oct. 26, 1977

[30] Foreign Application Priority Data

Dec. 15, 1976 [JP] Japan ..... 51/150456

[51] Int. Cl.[2] ..... G04B 19/24; G04C 3/00; G04B 19/30; G04B 27/00

[52] U.S. Cl. ..... 58/23 R; 58/4 A; 58/50 R; 58/58; 58/85.5

[58] Field of Search ..... 58/4 A, 23 R, 38 R, 58/50 R, 85.5; 235/92 T; 324/186; 340/324 R

[56] References Cited

U.S. PATENT DOCUMENTS

| | | | |
|---|---|---|---|
| 3,961,472 | 6/1976 | Riehl | 58/4 A |
| 4,045,691 | 8/1977 | Asano | 58/50 R |
| 4,045,692 | 8/1977 | Morokawa et al. | 58/50 R |
| 4,083,175 | 4/1978 | Petropoulus et al. | 58/4 A |

*Primary Examiner*—Edith S. Jackmon

*Attorney, Agent, or Firm*—Oblon, Fisher, Spivak, McClelland & Maier

[57] ABSTRACT

An electronic watch comprising a level setting circuit which consists of a resistive device and a switching element connected between a switch and a power source. The resistance value of the switching element is much smaller than that of the resistive device and the switching element is rendered non-conductive when the switch is in its on state and is rendered conductive when the switch is in its off state.

4 Claims, 4 Drawing Figures

ELECTRONIC WATCH HAVING IMPROVED LEVEL SETTING CIRCUIT

BACKGROUND OF THE INVENTION

1. Field of the Invention:

The present invention relates to an electronic watch and more particularly to an electronic wristwatch which comprises an improved level setting circuit. 2. Description of the Prior Art:

Electronic wristwatches and other small portable time keeping devices are well known. In FIG. 1, an example of a general electronic wristwatch is shown in block diagram. A clock pulse with predetermined frequency is produced at oscillator 10 and applied to frequency divider 11. The output pulse from the frequency divider 11 is applied to a seconds counter 12, in which the counting of the second pulse is made producing a minute pulse to be supplied to the minutes counter 13. In a similar manner, minutes counter 13, hours counter 14 and days counter 15 operate and the respective counter output is applied to selection circuit 16 to select one or some outputs of the counters, and the selected output is applied to the decode circuit 17, in which the count output is transformed into a segment signal that is applied to drive circuit 18. The drive circuit 18 drives display 19 such as a Liquid Crystal Display panel.

In an electronic watch of this type, time correction and the selective display of time are carried out using switches 20 and 21, level setting circuit 22 and control circuit 23. First switch 20 and second switch 21 are connected to first level setting circuit 24 and second level setting circuit 25 respectively, and the outputs of the level setting circuits are supplied to control circuit 23. The control circuit 23 sends out a time correction signal to the counters for changing the count content thereof, corresponding to the operation of first switch 20. On the other hand, corresponding to operation of the second switch 21, one or some count outputs are selected in the selection circuit 16 and displayed at display 19 by way of decode circuit 17 and drive circuit.

In FIG. 2, a prior art level setting circuit is shown. An inverter circuit 26 is connected to switch 20, and an N channel type MOS transistor 27 is connected between the input portion of the inverter circuit 26 and a power source $V_{SS}$ as a resistive means. The level setting circuit 24 outputs two level states.

Generally, the above-mentioned wristwatch system is formed as a module and further packaged in a metal package for shielding external noise. But if it is difficult to shield the module for some reason, the prior art circuit suffers from many disadvantages. Namely, if the resistance value of the resistive means is large, the input impedance seen from the switch becomes large. Accordingly, external noise is apt to enter into the wristwatch, causing the wristwatch to malfunction. On the other hand, to lower the input impedance, namely to prevent the malfunction, it might be proposed to lower the resistance of the MOS transistor 27, but in this case the current flowing in the MOS transistor 27 will become large. That is to say, power consumption becomes large, which shortens the battery life.

As mentioned above, it is difficult to select an ideal resistance value for the resistive means.

BRIEF DESCRIPTION OF THE DRAWINGS

The invention is illustrated by way of example in the accompanying drawings which form part of this application and in which.

BRIEF SUMMARY OF THE INVENTION

It is therefore an object of the present invention to provide an electronic watch with low power consumption.

It is a further object of the present invention to provide an electronic watch with high reliability.

According to the invention, an electronic watch comprises (a) a switch input means, (b) a level setting means connected to the switch input means, (c) a control circuit connected to the level setting means, (d) a time computer for producing a standard clock pulse connected to the control circuit, and (e) a display means for displaying time, receiving the output of the time computer, wherein said level setting means consists of a resistive means and a switching element whose conductive resistor value is much smaller than that of the resistive means, and the switching element is rendered nonconductive when the switch means is in the on state and is rendered conductive when the switch means is in the off state.

DETAILED DESCRIPTION OF THE PREFERRED EMBODIMENT

Figure 1:
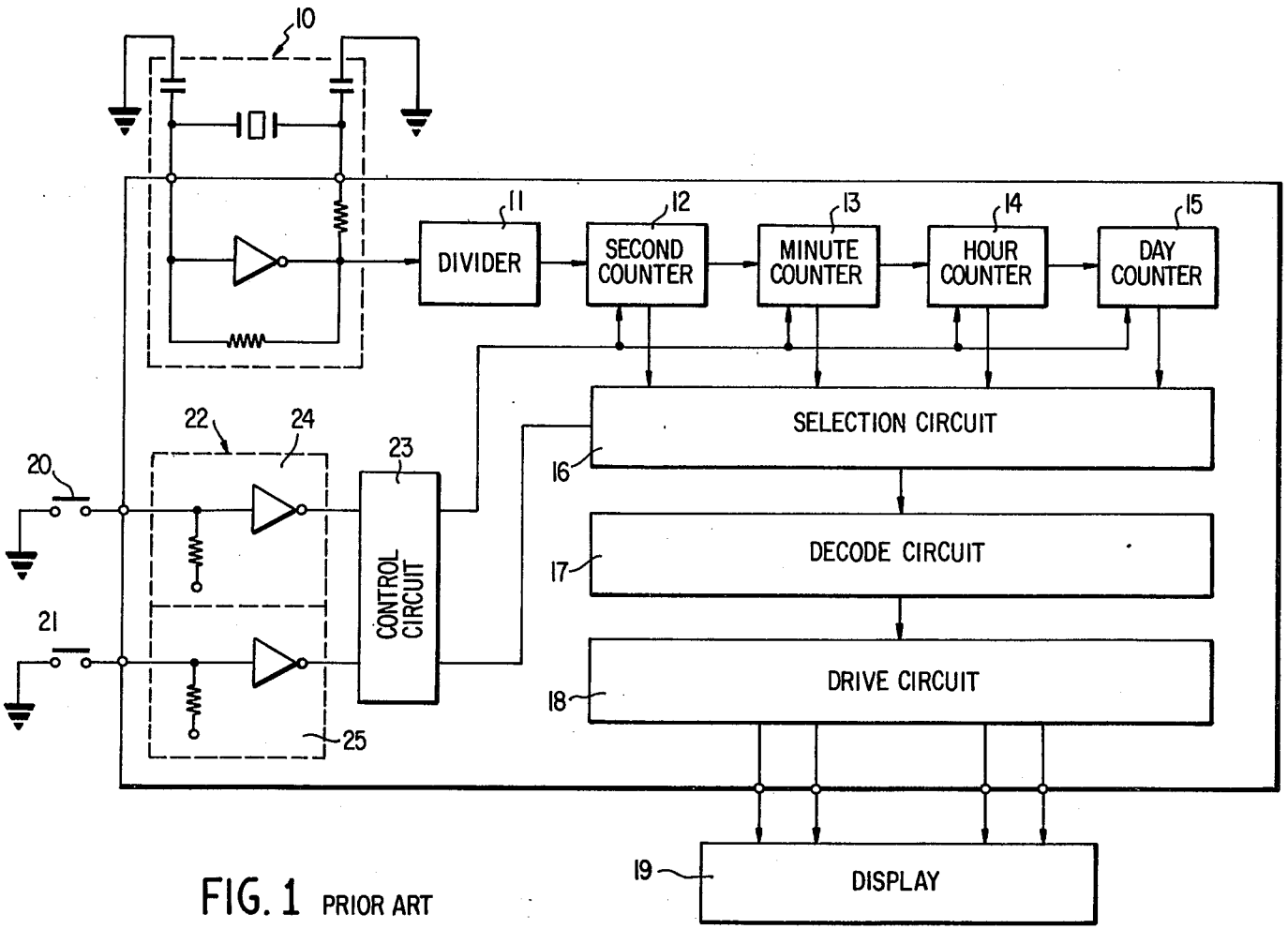
FIG. 1 PRIOR ART
FIG. 1 shows a block diagram of a prior art electronic watch.
Figure 2:
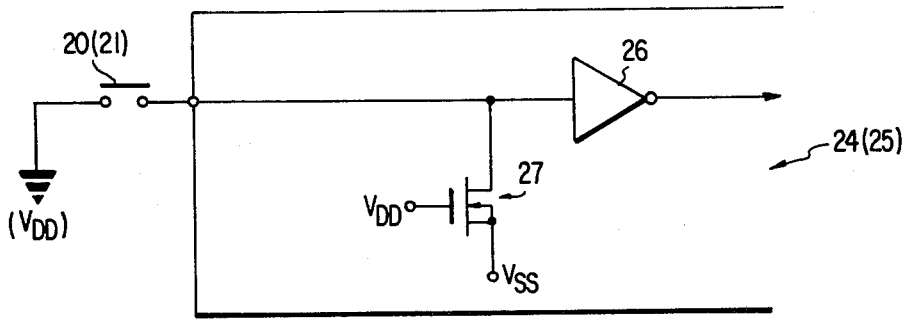
FIG. 2 PRIOR ART
FIG. 2 shows a circuit diagram of a prior art level setting circuit.
Figure 3:
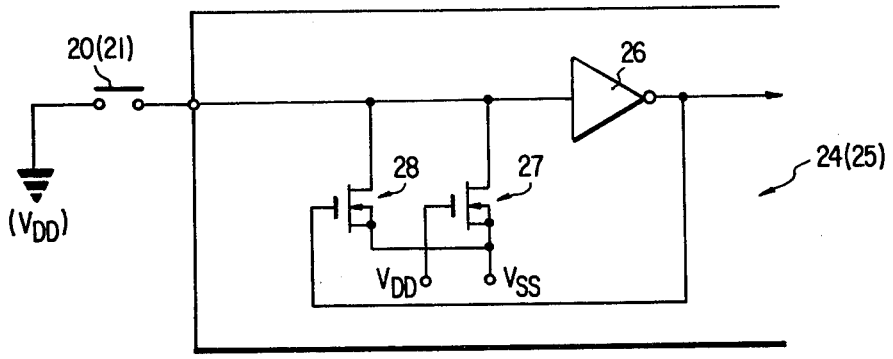
FIG. 3 shows a circuit diagram of a level setting circuit of a preferred embodiment according to the present invention.

Referring now to the drawings wherein like reference numerals refer to identical or corresponding parts throughout the specification and more particularly to FIG. 2 thereof, an inverter circuit 26 is connected to switch 20, and first and second N channel type MOS transistors 27 and 28 are connected between the input portion of inverter circuit 26 and a power source $V_{SS}$, the drain electrodes thereof connected to the input portion of inverter circuit 26 and source electrodes thereof connected to the power source $V_{SS}$. The voltage $V_{DD}$ is applied to the gate electrode of the first MOS transistor 27 which operates as a resistive means. On the other hand the gate electrode of the second MOS transistor 28 is connected to the output portion of the inverter circuit 26. Namely, the second MOS transistor 28 is rendered conductive or nonconductive according to the output signal of the inverter circuit 26. Here, the first MOS transistor 27 is made with much higher resistance than the second MOS transistor 28.

The operation of above-mentioned circuit diagram is as follows. First, if the switch 20 is in its off state, namely the switch input is not applied, the first MOS transistor 27 is conductive because the voltage $V_{DD}$ is applied to the gate electrode of the MOS transistor 27, the input level of the inverter circuit 26 is in the "L" state ($V_{SS}$), and the output level of the inverter circuit 26 is in the "H" state ($V_{DD}$). Therefore the second MOS transistor 28 is rendered conductive by gate input "$V_{DD}$", namely the output signal of the inverter circuit 26. The resistance value of the second MOS transistor 28 is much smaller than that of the first MOS transistor 27, so that the input impedance seen from the switch 20 is nearly determined by the resistance value of the second MOS transistor 28. In this case, the input impedance is very small, and therefore the electronic watch is insensitive to external noise and the malfunctioning of the wristwatch due to the external noise is prevented.

On the other hand, if the switch 20 is in its on state, namely the switch input is applied, the input level of the inverter circuit 26 is in the "H" state ($V_{DD}$) and the output level of the inverter circuit 26 is in the "L" state ($V_{ss}$). Accordingly, the signal level of the gate electrode changes from the "H" state ($V_{DD}$) to the "L" state ($V_{ss}$), which leads the second MOS transistor 28 to a nonconductive state. Namely, when switch 20 is in its on state, current flows through the first MOS transistor 27, which is usually in the on state and has a resistance value. Here, the power consumption of the first MOS transistor 27 becomes very slight.

According to the present invention, as it is possible to make the resistance value of the first MOS transistor 27 much larger than that of prior art circuit, the battery life is lengthened.

Figure 4:
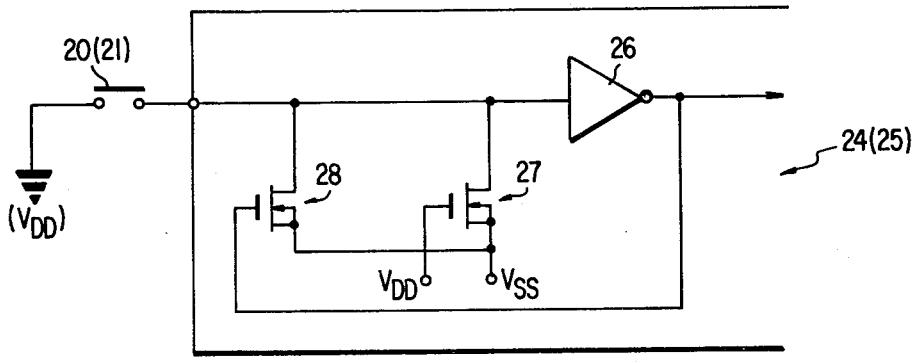
FIG. 4 shows a circuit diagram of a level setting circuit of another embodiment according to the present invention.

FIG. 4 shows another embodiment according to this invention. Second MOS transistor 28 is arranged closer to the switch 20 than the resistive means, namely first MOS transistor 27. In this embodiment, external noise is more perfectly prevented from entering the electronic watch.

Obviously, numerous modifications and variations of the present invention are possible in light of the above teaching. In above explanation, an N-channel type MOS transistor is used as a switching element, but another channel type MOS transistor or a junction type Field Effect Transistor may be used, and a resistor may be used as a resistive means.

It should now be apparent, as explained above, that the electronic watch according to this invention is improved in such a manner that, if the switch is in its off state, the input impedance seen from the switch means is made small, and if the switch is in its on state, the input impedance seen from switch means is made large. Accordingly, the power consumption of the electronic watch becomes small with high accuracy.

What is claimed as new and desired to be secured by Letters Patent of the United States is:

1. An electronic watch comprising:

(a) a switch input means, (b) level setting means connected to the switch input means and consisting of a switching element with an input electrode, and resistive means, respectively connected between the switch input means and a power source, and an inverter circuit whose input portion is connected to the switch input means and whose output portion is connected to the input electrode of the switching element, (c) a control circuit connected to the level setting means, (d) a time computer connected to the control circuit for producing a standard clock pulse, and (e) display means connected to receive the output of the time computer for displaying time, said display means being connected to the control circuit, wherein the switching element is arranged closer to the switch input means than the resistive means.

2. The electronic watch recited in claim 1 wherein: the resistive value of the switching element is much smaller than that of the resistive means, and the switching element is rendered non-conductive when the switch means is in its on state and is rendered conductive when the switch means is in its off state.

3. The electronic watch recited in claim 1 wherein: the switching element is a MOS transistor.

4. The electronic watch recited in claim 1 wherein: the switch input means consists of a first switch for correcting the time and a second switch for displaying the time selectively, and the level setting means consists of a first level setting circuit and a second level setting circuit respectively connected to the switches.

* * * * *